US010876445B2

(12) United States Patent
Kress et al.

(10) Patent No.: US 10,876,445 B2
(45) Date of Patent: Dec. 29, 2020

(54) HEATED INLET OF A CRANKCASE VENTILATION SYSTEM

(71) Applicant: Caterpillar Inc., Deerfield, IL (US)

(72) Inventors: Lee D. Kress, Lafayette, IN (US); Rodney A. Lawrence, Frankfort, IN (US); William Jenkins, Flora, IN (US)

(73) Assignee: Caterpillar Inc., Peoria, IL (US)

( * ) Notice: Subject to any disclaimer, the term of this patent is extended or adjusted under 35 U.S.C. 154(b) by 1 day.

(21) Appl. No.: 16/265,587

(22) Filed: Feb. 1, 2019

(65) Prior Publication Data

US 2020/0248596 A1 Aug. 6, 2020

(51) Int. Cl.

| | |
|---|---|
| ***F01M 13/00*** | (2006.01) |
| ***F02B 43/12*** | (2006.01) |
| ***F01P 3/20*** | (2006.01) |
| ***F01M 13/02*** | (2006.01) |
| ***F28D 7/16*** | (2006.01) |
| *F28D 21/00* | (2006.01) |
| *F02B 43/10* | (2006.01) |

(52) U.S. Cl.

CPC ..... *F01M 13/0033* (2013.01); *F01M 13/028* (2013.01); *F01P 3/20* (2013.01); *F02B 43/12* (2013.01); *F28D 7/1607* (2013.01); *F01M 2013/0038* (2013.01); *F01P 2060/18* (2013.01); *F02B 2043/103* (2013.01); *F28D 2021/004* (2013.01)

(58) Field of Classification Search

CPC ..... F01M 13/0033; F01M 13/028; F01M 2013/0038; F01M 13/02; F01P 3/20; F01P 2060/18; F02B 43/12; F02B 2043/103; F28D 7/1607

See application file for complete search history.

(56) References Cited

U.S. PATENT DOCUMENTS

| | | | | |
|---|---|---|---|---|
| 1,806,543 A * | 5/1931 | Kamrath | F01M 13/022 | 123/41.86 |
| 2,029,216 A * | 1/1936 | Barker | F01M 13/02 | 123/41.86 |
| 2,396,601 A * | 3/1946 | Palotsee | F01M 13/00 | 123/556 |
| 2,797,674 A | 7/1957 | Dolza | | |
| 2,984,226 A * | 5/1961 | Court | F01M 13/00 | 123/41.31 |
| 8,210,135 B2 | 7/2012 | Slaughter et al. | | |
| 9,228,557 B1 | 1/2016 | Pursifull | | |

FOREIGN PATENT DOCUMENTS

| | | |
|---|---|---|
| DE | 24 32 782 B2 | 1/1976 |
| DE | 103 23 265 | 12/2004 |

* cited by examiner

*Primary Examiner* — Syed O Hasan

(74) *Attorney, Agent, or Firm* — Bookoff McAndrews

(57) ABSTRACT

A method for ventilating a crankcase of an internal combustion engine using natural gas as a fuel source may include filtering ambient air through an air filter. The method may also include heating the filtered ambient air by a jacket heat exchanger. The method may further include directing the heated ambient air through an inlet of the crankcase to purge blow-by gases including natural gas from the crankcase.

20 Claims, 4 Drawing Sheets

HEATED INLET OF A CRANKCASE VENTILATION SYSTEM

TECHNICAL FIELD

The present disclosure relates generally to crankcases for internal combustion engines, and more particularly, to a heated inlet of a crankcase ventilation system for such internal combustion engines.

BACKGROUND

Internal combustion engines typically include a crankcase to provide a housing for a crankshaft of the engine. During operation of the engine, blow-by gases (e.g., gaseous fuel, air, and/or combustion gases) may leak into the crankcase. Blow-by gases may contaminate an oil lubricating system of the engine, may pressurize the crankcase, and may affect overall engine emissions. Further, if the engine employs gaseous fuel (e.g., natural gas or landfill gas) as a fuel source, the blow-by gases may include corrosive fumes, such as sulfur. The crankcase may include a ventilation system, such as an inlet/outlet breather system, to help purge the blow-by gases from the crankcase using fresh ambient air. When the engine is used in cold environments, the ambient air used in the ventilation system may be so cold that condensation (e.g., water) forms in the crankcase. The condensation may combine with the corrosive fumes of the natural gas which may form harmful acids in the crankcase.

German Publication No. DE10323265A1, published on Dec. 16, 2004 ("the '265 publication"), describes a ventilation system for a crankcase of an internal combustion engine. The '265 publication discloses a heat exchanger for heating filtered ambient air to dehumidify the crankcase and prevent water from freezing in the crankcase. A vent line is used to recirculate a mixture of ventilation gas (filtered and heated ambient air) and blow-by gases after the heated ambient air has passed through the crankcase. An oil bypass separator may be used to separate the blow-by gases in the mixture, which returns via a return line into an oil sump of the crankcase. However, the ventilation system of the '265 publication may not appropriately address constituents in the fuel (e.g., sulfur) that may form harmful acids in the crankcase. Further, the ventilation system of the '265 publication may not appreciate certain efficiencies in heating the filtered ambient air.

The systems and methods of the present disclosure may address or solve one or more of the problems set forth above and/or other problems in the art. The scope of the current disclosure, however, is defined by the attached claims, and not by the ability to solve any specific problem.

SUMMARY

In one aspect, a method for ventilating a crankcase of an internal combustion engine using natural gas as a fuel source may include filtering ambient air through an air filter. The method may also include heating the filtered ambient air by a jacket heat exchanger. The method may further include directing the heated ambient air through an inlet of the crankcase to purge blow-by gases including natural gas from the crankcase.

In another aspect, a crankcase ventilation system for an internal combustion engine using natural gas as a fuel source may include an air filter for receiving and filtering ambient air. The crankcase ventilation system may also include a jacket heat exchanger in fluid communication with the air filter for heating the filtered ambient air. The crankcase ventilation system may further include a crankcase of the internal combustion engine having an inlet in fluid communication with the heat exchanger for receiving the heated ambient air.

In yet another aspect, a crankcase ventilation system for an internal combustion engine using natural gas as a fuel source may include an air filter for receiving and filtering ambient air. The crankcase ventilation system may also include a jacket heat exchanger in fluid communication with the air filter and located downstream of the air filter. The jacket heat exchanger may include a shell having an inlet and an outlet located downstream of the inlet. The inlet and outlet may be coupled to a cooling system of the engine for flowing coolant through the shell of the jacket heat exchanger. The jacket heat exchanger may also include one or more tubes located inside the shell for receiving and directing the filtered ambient air through the heat exchanger. The coolant may be flowed around the one or more tubes for heating the filtered ambient air. The crankcase ventilation system may further include a crankcase of the internal combustion engine having an inlet in fluid communication with the heat exchanger for receiving the heated ambient air.

BRIEF DESCRIPTION OF THE DRAWINGS

The accompanying drawings, which are incorporated in and constitute a part of this specification, illustrate various exemplary embodiments and together with the description, serve to explain the principles of the disclosure.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Further, relative terms, such as, for example, "about," "substantially," "generally," and "approximately" are used to indicate a possible variation of ±10% in a stated value.

Figure 1:
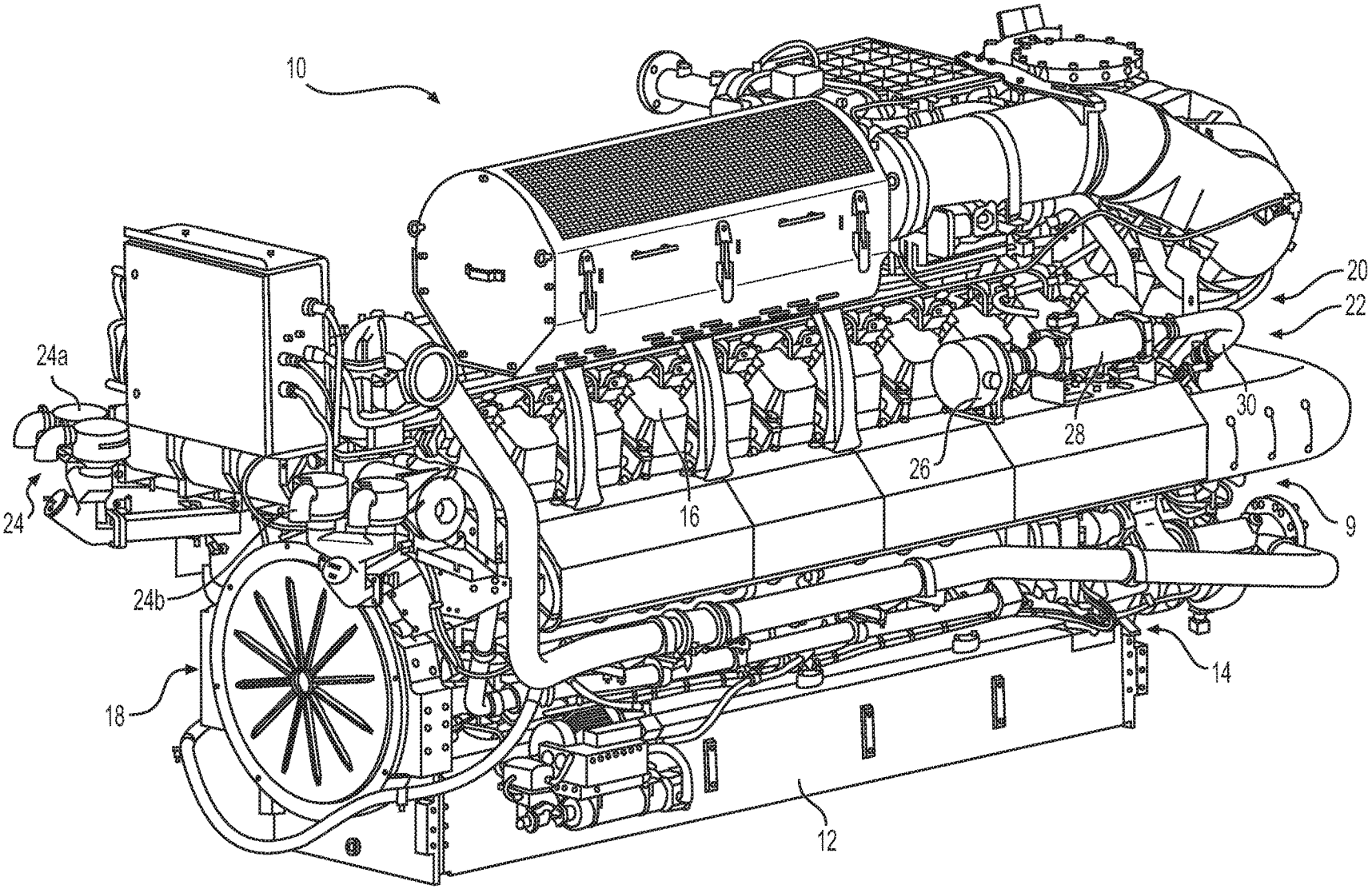
FIG. 1 is a perspective view of an internal combustion engine having an exemplary crankcase ventilation system, according to aspects of the disclosure.

FIG. 1 is a perspective view of an internal combustion engine 10 having an exemplary crankcase ventilation system 20, according to aspects of the disclosure. Engine 10 may be a stationary engine. As used herein, a "stationary engine" may be an engine with a framework that does not move. Stationary engines may be used to drive immobile equipment, such as pumps, generators, mills, or factory equipment. In one embodiment, engine 10 may be used in landfill applications for generating electricity. As such, engine 10 may employ gaseous fuel. As used herein, "gaseous fuel" may include fuel that is supplied to engine 10 in gaseous form. Gaseous fuel may include, for example, natural gas, propane, bio-gas, landfill gas, associated gas, carbon monoxide, hydrogen, or mixtures thereof. In an exemplary embodiment, the gaseous fuel may be a natural gas, such as associated gas. Natural gas is an exemplary gaseous fuel having various levels of purity. As used herein, "natural gas" refers to both pure and relatively impure forms having various amounts of methane and other constituents. Further, as used herein, "associated gas" is a form of natural gas including deposits of petroleum. While the exemplary embodiment is directed to stationary engines, it is understood that engine 10 may also be used in mobile applications (i.e., non-stationary) and may employ any type of fuel.

As shown in FIG. 1, engine 10 may include a frame 12. Frame 12 may support various components of engine 10, such as a crankcase 14, an engine block 9, and one or more cylinder heads 16 for one or more cylinders 11 (shown schematically in FIG. 2). Engine 10 may include any number of cylinders 11 arranged in any configuration such as inline, radial, "V," or any configuration known in the art. Frame 12 may further support a fuel system, an air system, a cooling system, a turbocharger, or any other conventional engine components.

Figure 2:
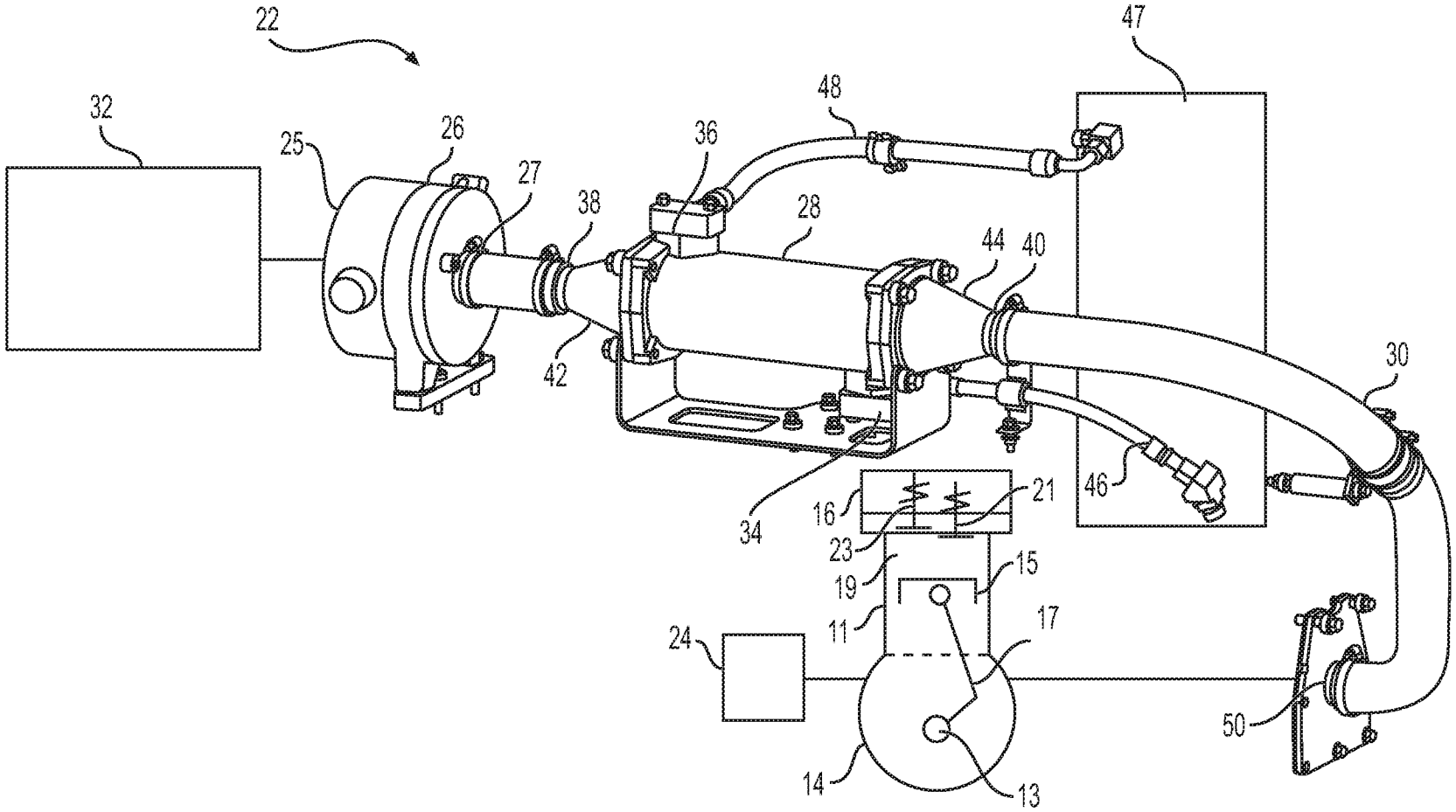
FIG. 2 is a perspective view of a heated inlet of the crankcase ventilation system isolated from the engine of FIG. 1.

With reference to FIG. 2, crankcase 14 may provide a housing for a crankshaft 13. Crankshaft 13 may be connected to a plurality of pistons 15 via connecting rods 17. The pistons 15 may be slidably and reciprocally disposed within the one or more cylinders 11 (which may be integrated into a single structure with crankcase 14) and covered by cylinder heads 16. Each cylinder 11, piston 15, and cylinder head 16 may together form a combustion chamber 19. Engine valves, such as intake valve 21 and exhaust valve 23, may control the flow of gases into and out of combustion chamber 19, and may be timed to move in relation to movement of a respective piston 15 during a stroke cycle of engine 10. For example, as piston 15 moves through an intake stroke, intake valve 21 may open to allow an air and fuel mixture to be drawn or forced into combustion chamber 19. During compression and power (combustion) strokes, both intake valve 21 and exhaust valve 23 may be closed to minimize leakage of gases from combustion chamber 19. During an exhaust stroke, exhaust valve 23 may open to allow byproducts of combustion to be pushed from combustion chamber 19. Thus, pistons 15 may power crankshaft 13 to provide a useful mechanical working motion to a flywheel 18, as is known in the art.

During operation of engine 10, blow-by gases may leak into crankcase 14. As used herein, "blow-by" gases may include leakage of air, fuel, combustion gases and/or a mixture thereof between a piston 15 and a cylinder wall of one or more cylinders 11 into the crankcase 14. When gaseous fuel is used as a fuel source for engine 10, blow-by gases may include, for example, sulfur or the like. Crankcase 14 may include a crankcase ventilation system 20 configured to purge the blow-by gases from crankcase 14. Crankcase ventilation system 20 may be an inlet/outlet breather system for purging blow-by gases from crankcase 14. In one embodiment, crankcase ventilation system 20 may be a non-ingestive ventilation system. As used herein, a "non-ingestive ventilation system" vents the blow-by gases out of the engine (e.g., to atmosphere). As such, crankcase ventilation system 20 may include an inlet 22 for directing ambient air into crankcase 14 and an outlet 24 for exhausting the blow-by gases from crankcase 14 and out of engine 10 to the atmosphere. Thus, the vented blow-by gases may not be reintroduced to the combustion process of engine 10. Outlet 24 may include a filtration system to filter the blow-by gases prior to exiting outlet 24. In one embodiment, inlet 22 may be a heated inlet configured to direct heated ambient air into crankcase 14, as further detailed below. As shown in FIG. 1, inlet 22 may include a single inlet and outlet 24 may include a first outlet 24*a* and a second outlet 24*b* such that outlet 24 is a dual outlet. It is understood that crankcase ventilation system 20 may include any number of inlets and/or outlets, as necessary.

FIG. 2 is a perspective view of heated inlet 22 of crankcase ventilation system 20 isolated from engine 10. As shown in FIG. 2, heated inlet 22 may include an air filter 26, a jacket heat exchanger 28, and an inlet hose 30. As used herein, a "jacket heat exchanger" includes a casing surrounding a component to form a cavity between the casing and the component such that fluid may flow through the cavity to transfer heat between the fluid and the component. Heated inlet 22 may further include a positive pressure system 32 for directing ambient air into air filter 26. Positive pressure system 32 may be, for example, a blower, a fan, or the like, such that the ambient air is "pushed" through crankcase ventilation system 20. Air filter 26 may be in fluid communication with positive pressure system 32 and may be located downstream from positive pressure system 32. For example, air filter 26 may include an inlet 25 coupled to an outlet of positive pressure system 32. Air filter 26 may include fibrous or porous materials for removing solid particulates (e.g., dust, pollen, mold, bacteria, etc.) from the ambient air. For example, air filter 26 may include paper filters, foam filters, cotton filters, or the like. Air filter 26 may further include an outlet 27 located downstream of the fibrous or porous material. It is understood that air filter 26 may include any type of filter as is known in the art for removing solid particulates from the ambient air. Further, while the exemplary embodiment includes a positive pressure system 32, crankcase ventilation system 20 may include a negative pressure system for directing ambient air into air filter 26 and through crankcase ventilation system 20. For example, a vacuum (e.g., a fan or pump) may be coupled to, and in fluid communication with, outlet 24 of crankcase ventilation system 20 such that air is "pulled" through the crankcase ventilation system 20 from the heated inlet 22, through crankcase 14, and out of outlet 14.

Jacket heat exchanger 28 may be in fluid communication with air filter 26 and may be located downstream from air filter 26. Jacket heat exchanger 28 may be, for example, a shell and tube heat exchanger. As such, jacket heat exchanger 28 may include a shell inlet 34, a shell outlet 36, a tube-side inlet 38, and a tube-side outlet 40. Tube-side inlet 38 may be coupled (directly or by a hose/pipe) to outlet 27 of air filter 26 and thus in fluid communication with air filter 26. Jacket heat exchanger 28 may further include a tube-side inlet plenum 42 and a tube-side outlet plenum 44. Tube-side inlet plenum 42 and tube-side outlet plenum 44 may include generally truncated cone shapes for directing the ambient air into and out of one or more tubes 54, as further detailed below with reference to FIG. 3. Shell inlet 34 may be coupled to, and in fluid communication with, a hose 46 and shell outlet 36 may be coupled to, and in fluid communication with, a hose 48 for circulating fluid through jacket heat exchanger 28 to heat the filtered ambient air to a desired temperature, as further detailed below. In one embodiment, the fluid may be engine coolant. As used herein, "engine coolant" is a water-based liquid that may be mixed with antifreeze additives. For example, hoses 46, 48 may be coupled to a cooling system 47 of engine 10 for providing engine coolant to jacket heat exchanger 28 to heat the filtered ambient air. Cooling system 47 may be a first cooling system of engine 10 and engine 10 may include a second cooling system. Cooling system 47 may be a high temperature cooling system such that a temperature of the engine coolant may include a high temperature throughout cooling system 47. For example, the temperature of engine coolant in cooling system 47 may be in a range from eighty degrees Celsius (80° C.) to one-hundred and twenty degrees Celsius (120° C.) throughout cooling system 47 during operation of engine 10.

Hose 46 may be coupled to, and in fluid communication with, cooling system 47 at a first location and hose 48 may be coupled to, and in fluid communication with, cooling system 47 at a second location downstream of the first location. For example, hose 46 may be coupled to a casting of cooling system 47 downstream and adjacent a water pump (e.g., for pumping engine coolant) of cooling system 47. Hose 48 may be coupled to a water manifold of cooling system 47 upstream of an outlet of cooling system 47. Thus, engine coolant may flow in one direction from hose 46 through jacket heat exchanger 28 and then through hose 48. Further, hose 46 may be located and arranged below shell inlet 34 of jacket heat exchanger 28 and hose 48 may be located and arranged above shell outlet 36 of jacket heat exchanger 28. As such, air pockets in hose 48, jacket heat exchanger 28, and hose 46 may be prevented from forming when engine 10 is running. Further, engine coolant may drain out of hose 48, jacket heat exchanger 28, and hose 46 (from hose 48 to hose 46) when engine 10 is shutdown.

Crankcase inlet hose 30 may be in fluid communication with jacket heat exchanger 28 and located downstream from jacket heat exchanger 28. As such, inlet hose 30 may be coupled at one end to tube-side outlet 40 of jacket heat exchanger 28. Inlet hose 30 may further be coupled at another end to an inlet 50, or intake, of crankcase 14. Thus, inlet hose 30 may be configured to direct the heated ambient air from jacket heat exchanger 28 into crankcase 14, as further detailed below. Inlet hose 30 may include a material, such as silicone or the like, for providing insulation for the heated ambient air. It is understood that any type of material may be used for inlet hose 30 to provide insulation for the heated ambient air.

Figure 3:
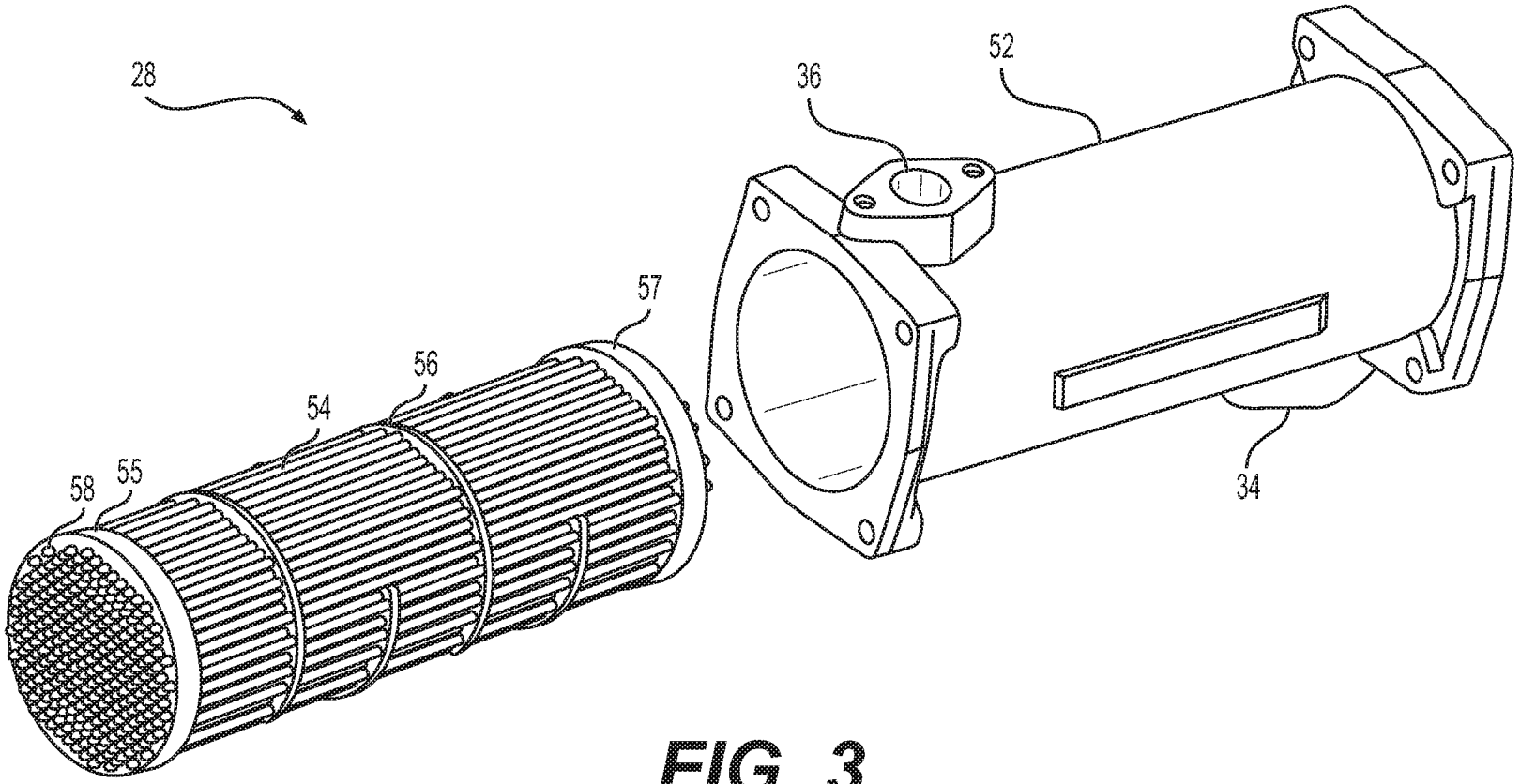
FIG. 3 is an exploded perspective view of an exemplary jacket heat exchanger of the heated inlet isolated from the engine of FIG. 1.

FIG. 3 is an exploded perspective view of jacket heat exchanger 28 isolated from engine 10. As shown in FIG. 3, jacket heat exchanger 28 may include a shell 52 for receiving and directing coolant through jacket heat exchanger 28 via shell inlet 34 and shell outlet 36. For example, shell inlet 34 may be located at a first end and on a first side of shell 52. Shell outlet 36 may be located at a second end and on a second side of shell 52, the second end and the second side being opposite the first end and the first side, respectively. Jacket heat exchanger 28 may further include a bundle of one or more tubes 54, or conduits, for receiving and directing the filtered ambient air through jacket heat exchanger 28.

The bundle of one or more tubes 54 may include end plates 55, 57 and one or more baffles 56 for directing the flow of coolant through shell 52 and around each of the one or more tubes 54. Each of the end plates 55, 57 and the one or more baffles 56 may include one or more holes 58 for receiving a respective one of the one or more tubes 54, thus bundling the one or more tubes 54 into a single structure. Each of the one or more baffles 56 may include a generally semi-circle shape. The one or more baffles 56 may be arranged such that openings of the semi-circles are offset with respect to one another. For example, a first and third baffle 56 may be arranged such that the openings of the semi-circles are oriented in a first direction and a second and fourth baffle 56 may be arranged such that the openings of the semi-circles are oriented in a second direction opposite of the first direction. Thus, the one or more baffles 56 may provide a serpentine path for the coolant from shell inlet 34 to shell outlet 36 to distribute the coolant around each of the one or more tubes 54. It is understood that any number of baffles 56 including any shape may be used and may be arranged in any pattern for directing the flow of coolant through shell 52 and around the one or more tubes 54.

The bundle of one or more tubes 54 may be sized to be inserted into shell 52 such that there may be clearance between shell 52 and the one or more tubes 54, and between individual tubes 54. Further, end plates 55, 57 may be sized to fit within shell 52 with minimal clearance to seal against an inner surface of shell 52. For example, when the bundle of one or more tubes 54 is inserted into shell 52, end plates 55, 57 may be located behind shell inlet 34 and shell outlet 36, respectively, such that coolant does not flow in to inlets or outlets of the one or more tubes 54. The shell 52, with the one or more tubes 54, may be coupled at one end to tube-side inlet plenum 42 and at another end to tube-side outlet plenum 44. For example, tube-side inlet plenum 42 may be located adjacent shell outlet 36 and tube-side outlet plenum 44 may be located adjacent shell inlet 34. It is understood that shell 52, tube-side inlet plenum 42, and tube-side outlet plenum 44 may be separate components of jacket heat exchanger 28 such that the bundle of one or more tubes 54 may be removed from shell 52 for maintenance or replacement. However, shell 52, tube-side inlet plenum 42, and tube-side outlet plenum 44 may be formed as a single structure. Thus, jacket heat exchanger 28 may be a straight-tube heat exchanger including a one pass tube-side flow (e.g., tube-side inlet 38 is located on a first side and tube-side outlet 40 is on a second side different than the first side). However, jacket heat exchanger 28 may be a U-tube heat exchanger, in which the one or more tubes 54 include a "U" shape such that the tube-side inlet 38 and tube-side outlet 40 are on the same side. Jacket heat exchanger 28 may also be a straight-tube heat exchanger including a two pass tube-side flow, in which tube-side inlet 38 and tube-side outlet 40 are located on the same side and the ambient air enters through a first set of tubes 54 and exits through a second set of tubes 54.

INDUSTRIAL APPLICABILITY

The disclosed heated inlet 22 of crankcase ventilation system 20 of the present disclosure may be used with a crankcase 14 of any internal combustion engine 10 that utilizes gaseous fuel as a fuel source.

Figure 4:
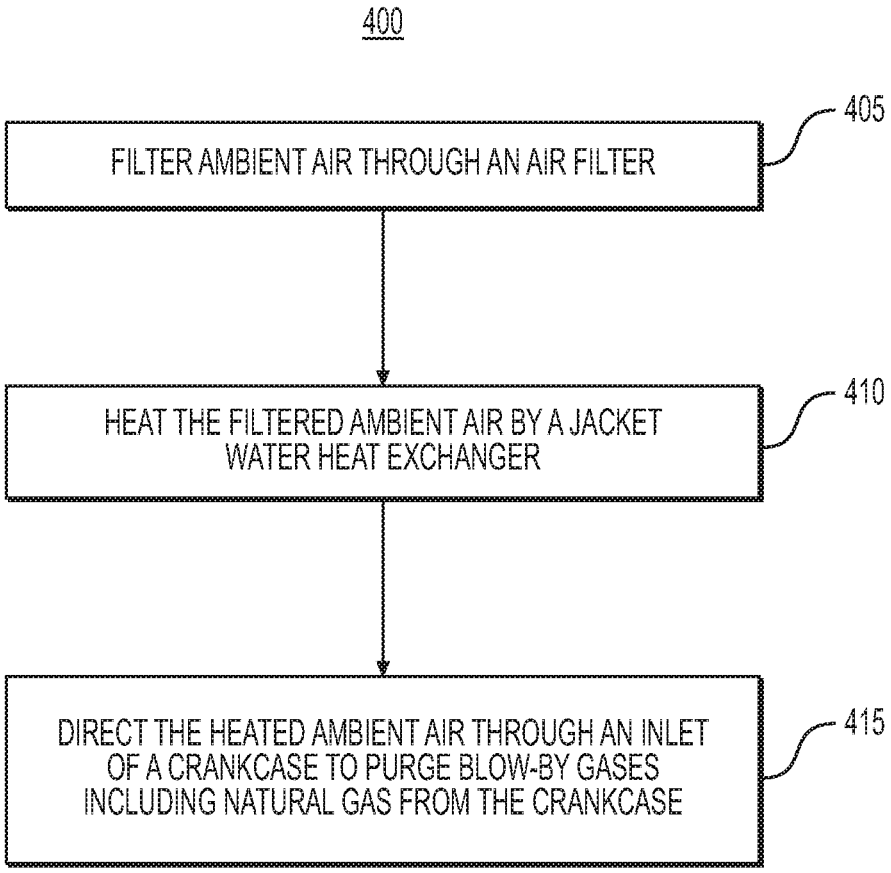
FIG. 4 provides a flowchart depicting an exemplary method for ventilating a crankcase of the internal combustion engine of FIG. 1.

FIG. 4 provides a flowchart depicting an exemplary method 400 for ventilating a crankcase 14 of an internal combustion engine 10 using natural gas as a fuel source. In step 405, ambient air may be filtered through air filter 26. For example, the ambient air may be directed into air filter 26 by positive pressure system 32 (e.g., a fan or blower) or a negative pressure system (e.g., a fan or pump).

In step 410, the filtered ambient air may be heated by jacket heat exchanger 28. For example, the filtered ambient air may be directed from air filter 26 through tube-side inlet 38 into tube-side inlet plenum 42. Tube-side inlet plenum 42 may direct the filtered ambient air into each of the one or more tubes 54. As the filtered ambient air passes through the one or more tubes 54, the filtered ambient air may be heated by directing engine coolant through shell 52 and around the one or more tubes 54. As such, coolant may be directed into shell 52 from the engine cooling system into shell inlet 34. The coolant may flow from shell inlet 34, around the one or more tubes 54, and exit shell 52 through shell outlet 36. As detailed above, the coolant may be directed around the one or more tubes 54 by the one or more baffles 56. Thus, the coolant may heat the filtered ambient air as the filtered ambient air flows through the one or more tubes 54. As such, a temperature of the filtered ambient air at tube-side outlet 40 may be higher than a temperature of the filtered ambient air at tube-side inlet 38. In one embodiment, the filtered ambient air may be heated by jacket heat exchanger 28 such that the temperature of the filtered ambient air at tube-side outlet 40 is at least fifty-five degrees Celsius (55° C.). In one embodiment, the filtered ambient air may be heated by jacket heat exchanger 28 such that the temperature of the filtered ambient air at tube-side outlet 40 is within a range of fifty-five degrees Celsius (55° C.) to one-hundred and ten degrees Celsius (110° C.).

In step 415, the heated ambient air may be directed through an inlet 50 of crankcase 14 to purge blow-by gases including natural gas from the crankcase. For example, the heated ambient air may exit the one or more tubes 54 into tube-side outlet plenum 44. Tube-side outlet plenum 44 may direct the heated ambient air through tube-side outlet 40 into inlet hose 30. Inlet hose 30 may direct the heated ambient air through inlet 50 and into crankcase 14. The heated ambient air may mix with the blow-by gases in crankcase 14 to purge the blow-by gases from crankcase 14 and the air-gas mixture may then be exhausted through outlet 24 out of engine 10.

The heated inlet 22 of crankcase ventilation system 20 of the present disclosure may help to purge corrosive fumes of blow-by gases that include natural gas (e.g., sulfur) from crankcase 14. Further, the jacket heat exchanger 28 of heated inlet 22 may heat the filtered ambient air to prevent the corrosive fumes of the blow-by gases (including the natural gas) from forming harmful acids in crankcase 14. In addition, utilizing coolant of the existing cooling system 47 of engine 10 may provide a system that automatically maintains an appropriate temperature of the jacket heat exchanger 28, by using the existing engine cooling control. Further, the disclosed system may avoid the need for a separate heating system to heat the filtered ambient air for jacket heat exchanger 28.

It will be apparent to those skilled in the art that various modifications and variations can be made to the disclosed system without departing from the scope of the disclosure. Other embodiments of the disclosure will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method for ventilating a crankcase of an internal combustion engine using natural gas as a fuel source, comprising:

filtering ambient air through an air filter;

heating the filtered ambient air by a jacket heat exchanger, wherein the jacket heat exchanger includes:

a shell in fluid communication with a cooling system of the engine for receiving and directing coolant from the cooling system through the heat exchanger; and one or more tubes located inside the shell, the one or more tubes in fluid communication with the air filter for receiving and directing the filtered ambient air through the heat exchanger, wherein the coolant is flowed around the one or more tubes for heating the filtered ambient air; and directing the heated ambient air through an inlet of the crankcase to purge blow-by gases including natural gas from the crankcase.

2. The method of claim 1, wherein the shell includes an inlet coupled to the cooling system at a first location and an outlet coupled to the cooling system at a second location downstream of the first location.

3. The method of claim 2, wherein the coolant is flowed from the inlet to the outlet around the one or more tubes in a serpentine pattern.

4. The method of claim 3, wherein the inlet is coupled to the cooling system downstream of a pump of the cooling system, and wherein the outlet is coupled to the cooling system upstream of an outlet of the cooling system.

5. The method of claim 4, wherein heating the filtered ambient air includes heating the filtered ambient air to a temperature of at least fifty-five degrees Celsius (55° C.).

6. The method of 1, wherein the blow-by gases further include at least one of air, fuel, or combustion gases.

7. The method of claim 1, further comprising:

exhausting the purged natural gas through an outlet and out of the engine.

8. The method of claim 1, wherein the engine is a stationary engine.

9. The method of claim 1, wherein the jacket heat exchanger further includes one or more baffles around the one or more tubes for directing and distributing the coolant around the one or more tubes.

10. The method of claim 9, wherein each of the one or more baffles includes a generally semi-circle shape, and wherein the one or more baffles are arranged such that the openings of the semi-circle shape are offset with respect to one another.

11. A crankcase ventilation system for an internal combustion engine using natural gas as a fuel source, comprising:

an air filter for receiving and filtering ambient air;

a jacket heat exchanger in fluid communication with the air filter for heating the filtered ambient air, wherein the jacket heat exchanger includes:

a shell in fluid communication with a cooling system of the engine for receiving and directing coolant from the cooling system through the heat exchanger; and one or more tubes located inside the shell, the one or more tubes in fluid communication with the air filter for receiving and directing the filtered ambient air through the heat exchanger, wherein the coolant is flowed around the one or more tubes for heating the filtered ambient air; and a crankcase of the internal combustion engine having an inlet in fluid communication with the heat exchanger for receiving the heated ambient air.

12. The crankcase ventilation system of claim 11, wherein the shell includes an inlet coupled to the cooling system at a first location and an outlet coupled to the cooling system at a second location downstream of the first location.

13. The crankcase ventilation system of claim 12, wherein the inlet is coupled to the cooling system downstream of a pump of the cooling system, and wherein the outlet is coupled to the cooling system upstream of an outlet of the cooling system.

14. The crankcase ventilation system of claim 13, wherein the jacket heat exchanger further includes one or more baffles around the one or more tubes for directing and distributing the coolant around the one or more tubes.

15. The crankcase ventilation system of claim 14, wherein the one or more baffles are arranged such that coolant is flowed from the inlet to the outlet around the one or more tubes in a serpentine pattern.

16. The crankcase ventilation system of claim 11, further including an outlet in fluid communication with the crankcase for exhausting blow-by gases from the crankcase and out of the engine.

17. The crankcase ventilation system of claim 15, wherein each of the one or more baffles includes a generally semi-circle shape, and wherein the one or more baffles are arranged such that the openings of the semi-circle shape are offset with respect to one another to direct the coolant in the serpentine pattern.

18. A crankcase ventilation system for an internal combustion engine using natural gas as a fuel source, comprising:

an air filter for receiving and filtering ambient air;

a jacket heat exchanger in fluid communication with the air filter and located downstream of the air filter, the jacket heat exchanger including:

a shell having an inlet and an outlet located downstream of the inlet, the inlet and outlet coupled to a cooling system of the engine such that the shell is in fluid communication with the cooling system for flowing coolant through the shell;

one or more tubes located inside the shell, the one or more tubes in fluid communication with the air filter for receiving and directing the filtered ambient air through the heat exchanger, wherein the coolant is flowed around the one or more tubes for heating the filtered ambient air; and one or more baffles around the one or more tubes for directing and distributing the coolant around the one or more tubes; and a crankcase of the internal combustion engine having an inlet in fluid communication with the heat exchanger for receiving the heated ambient air.

19. The system of claim 18, wherein the one or more baffles are arranged such that the coolant is flowed from the inlet to the outlet around the one or more tubes in a serpentine pattern.

20. The crankcase ventilation system of claim 19, wherein each of the one or more baffles includes a generally semi-circle shape, and wherein the one or more baffles are arranged such that the openings of the semi-circle shape are offset with respect to one another to direct the coolant in the serpentine pattern.

* * * * *